US006578288B2

(12) United States Patent
Bernstein

(10) Patent No.: US 6,578,288 B2
(45) Date of Patent: Jun. 17, 2003

(54) SIDE ENTRY FOOTWEAR

(76) Inventor: Noam Bernstein, 3 Brosh Street, P.O. Box 244, Omer (IL), 84965

( * ) Notice: Subject to any disclaimer, the term of this patent is extended or adjusted under 35 U.S.C. 154(b) by 0 days.

(21) Appl. No.: 09/893,908

(22) Filed: Jun. 29, 2001

(65) Prior Publication Data

US 2003/0009916 A1 Jan. 16, 2003

(51) Int. Cl.[7] ..... A43C 11/00; A43B 11/00

(52) U.S. Cl. ..... 36/50.1; 36/11.5; 36/58.5; 36/106; 36/138

(58) Field of Search ..... 36/106, 15, 101, 36/11.5, 138, 50.1, 45, 69, 58.5, 58.6

(56) References Cited

U.S. PATENT DOCUMENTS

| | | | | | |
|---|---|---|---|---|---|
| 300,394 | A | * | 6/1884 | Pelletier | 36/50.1 |
| 417,460 | A | * | 12/1889 | Wurtele | 36/138 |
| 884,520 | A | * | 4/1908 | McIntire | 36/58.5 |
| 1,832,736 | A | * | 11/1931 | Raposy | 36/58.5 |
| 2,358,474 | A | * | 9/1944 | Pope | 36/166 |
| 2,677,201 | A | * | 5/1954 | Lyon | 36/11 |
| 2,693,039 | A | * | 11/1954 | Balut | 36/51 |
| 3,431,658 | A | * | 3/1969 | Finn | 36/58.5 |
| 3,621,592 | A | * | 11/1971 | Goldmerstein | 36/138 |
| 5,056,240 | A | * | 10/1991 | Sherrill | 36/138 |
| 5,926,978 | A | * | 7/1999 | Smith | 36/101 |
| 6,351,897 | B1 | * | 3/2002 | Smith | 36/50.1 |

* cited by examiner

*Primary Examiner*—M. D. Patterson
(74) *Attorney, Agent, or Firm*—Finnegan, Henderson, Farabow, Garrett & Dunner, L.L.P.

(57) ABSTRACT

Footwear includes an upper disconnected from the sole on at least a portion of one lateral side of the sole to enable a foot to enter the footwear laterally through a side gap. The foot may be held in place, in part, with a resilient foot holder extending over the top of the foot. A lateral motion of the foot may overcome the force of the foot holder enabling hands-free removal of the footwear.

21 Claims, 7 Drawing Sheets

SIDE ENTRY FOOTWEAR

BACKGROUND OF THE INVENTION

1. Field of the Invention

The invention relates to footwear that may be donned and removed with minimum effort. More particularly, the invention relates to side entry footwear in which the foot enters and exits laterally through a side opening in the footwear.

2. Description of Related Art

Footwear can generally be divided into two categories: those with fasteners and those without. Footwear with fasteners typically require manual fastening. This means bending over, reaching for the feet, and fastening (whether it be laces, Velcro, buckles, or other closures) using rather precise motor skills. There are generally two types of footwear without fasteners: "slip-on" footwear and other footwear that uses elastic material to hold the foot in place. Slip-on footwear usually does not require any fastening, but may not hold the foot well. Footwear employing elastic material to hold the foot in place often requires the wearer to bend down and manually pull on the footwear using force.

Due to physical limitations or simply a desire for footwear that is easier to don or remove, individuals might prefer a shoe with a nontraditional design. For example, the elderly might suffer from common conditions such as arthritis, osteoporosis, deterioration of eyesight, and loss of flexibility of tendons and muscles. Neural problems resulting from diabetes (also common among elderly) and hip replacements add to conditions that make donning traditional footwear difficult.

Existing footwear often is not fitted for use by the elderly. "Slip-on" shoes, though common and practical, might not provide the traction or structural support needed to prevent falls. Donning other types of shoes is often so difficult that the elderly may opt not to use shoes at all. In some cases, the traction afforded by bare and feeble feet might pose more of a risk than wearing a loose fitting pair of slip-on shoes. Among the elderly, accidents are not only a cause for lack of independence, but are also a common cause of death. Of these accidents, many are associated with falls in the home.

SUMMARY OF A FEW ASPECTS OF THE INVENTION

The invention may include footwear having a sole with a toe region, a heel region, and first and second opposing lateral sides. An upper may be connected to the sole along at least a portion of the first lateral side and may be disconnected from the sole in an opening region along at least a portion of the second lateral side. A resilient foot holder is at least partially disconnected from the second side of the sole at the opening region to thereby permit lateral foot entry through the opening region. The foot holder may exert a holding force on the foot to help prevent the foot from slipping out of the opening region during walking. The foot holder may deform to permit the foot to slip out through the opening region in response to a lateral foot motion. While the resilient foot holder may be connected or disconnected from the sole, in a preferred embodiment it is connected to the sole along a first side of the sole.

The footwear may include at least one protrusion extending from the sole. The protrusion is configured to engage another protrusion on an opposite foot of a wearer, to thereby assist the wearer in removing the footwear.

In addition to the foot holder, the footwear may also include a heel holder to cooperate in preventing the foot from slipping out of the opening region during walking. One or more of the heel holder and the foot holder may include a curved surface such as a flipped-back lip for guiding the foot into the opening region. The flipped-back lip may be in the form of a loop and may have an outer radius that is greater than an inner radius. The foot holder may be curved to generally conform to a metatarsal portion of the foot. One or more of the foot holder and the heel holder may be made of a semi-rigid resilient material capable of deforming during entry and egress of a foot.

The sole may include a peripheral ridge for at least partially surrounding the foot to assist in preventing the foot from slipping out of the opening region during walking. The sole may further include texture on a foot contacting surface. The texture may be oriented to make it easier for the foot to slip into the opening region than for the foot to exit the opening region.

While the footwear may have particular benefit for the elderly and those with physical limitations, the invention in its broadest sense is not so limited. It may be configured for use by those without physical constraints, but who desire an alternative approach to footwear. Thus, the invention can be used in slippers, or in any other appropriate footwear product.

Other aspects of the invention will be evident from the description of preferred embodiments and the brief description of the drawings that follow. The following drawings constitute a part of the specification, and together with the Description of Preferred Embodiments, exemplify aspects and principals of the invention.

DESCRIPTION OF PREFERRED EMBODIMENTS

Figure 1:
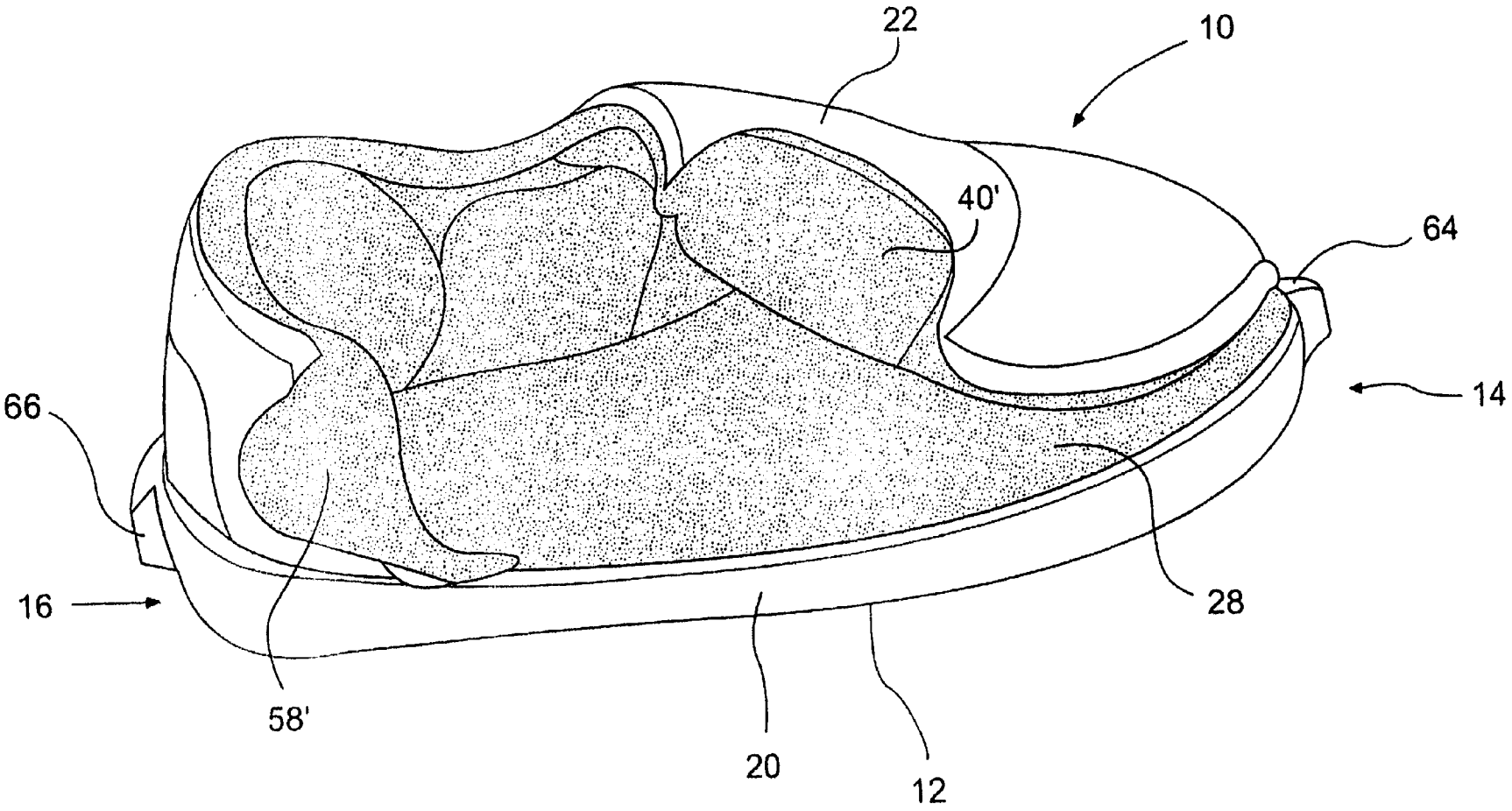
FIG. 1 is a perspective view of one example of footwear in accordance with the invention.
Figure 2A:
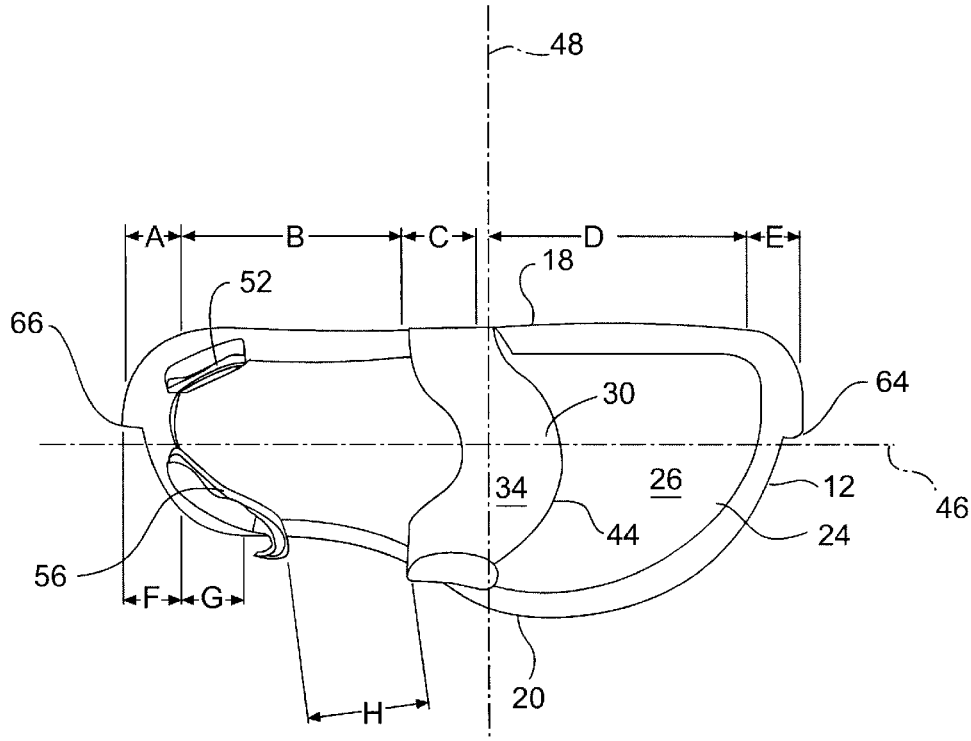
FIG. 2A is a dimensioned top view of the footwear of FIG. 1 with the fabric of the upper removed.

In accordance with the invention and as illustrated in FIG. 1, footwear 10 may include a sole 12 having a toe region 14 and a heel region 16. As illustrated in FIG. 2A, the sole 12 may have first and second opposing lateral sides 18 and 20, respectively.

While the invention, in its broadest sense, does not require any particular material for the sole, in a preferred embodiment, the sole is made up of lightweight material having a coefficient of friction sufficient to prevent slipping and being configured to absorb shock and/or force and substantially return to its original shape thereafter. One material that may be particularly suitable for the sole is polyurethane foam.

As illustrated in FIG. 2A, a ridge 24 surrounds the perimeter of the sole. The ridge assists in preventing the foot from slipping out of the opening during walking. In an alternative embodiment (not shown), the ridge may only partially surround the periphery of the sole. In a further alternative embodiment (not shown), the ridge may be divided into a series of disconnected sections. If the sole is made of polyurethane foam, the ridge 24 may be integrally molded into the sole. Alternatively, the ridge may be formed in an another suitable way. Depending on construction, comfort considerations, and design considerations, the invention may be practiced without ridge 24.

Figure 2B:
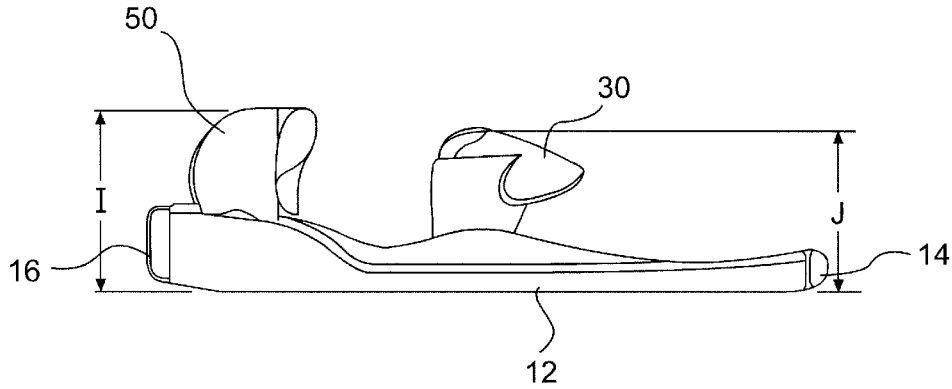
FIG. 2B is a side view of the footwear of FIG. 2A.

In a preferred embodiment, and as illustrated in FIG. 2B, the sole 12 curves slightly upward in the toe region 14 and the heel region 16.

The bottom of the sole (not shown) may include a texture or pattern to improve friction. A foot contacting portion of the sole 26 may include texture such as bumps to stimulate blood flow and to provide neural stimulation.

As illustrated in FIGS. 2A and 2B, the thickness of the sole on side 18 may be greater than the thickness on side 20 to aid in entry/egress of the foot.

In accordance with the invention there is also provided an upper connected to the sole along at least a portion of the first lateral side and being disconnected from the sole in an opening region along at least a portion of the second lateral side. In a preferred embodiment of the invention, and as illustrated in FIG. 1, upper 22 is connected to sole 12 along lateral first side 18 and is disconnected from sole 12 along a portion of second side 20. The disconnection of the upper from the sole defines opening region 28 generally extending from the toe region 14 toward the heel region 16. Depending on how it is constructed, the upper 22 may be designed for esthetics and/or warmth. The upper may include layers of fabric stitched together. Interposed between the layers may be material somewhat less flexible than the outer fabric to give the footwear a measure of form. Padding may be stitched between layers of fabric to add comfort.

While the opening region 28 is illustrated on lateral side 20 of the sole 12, it is within the scope of the invention to reverse the orientation of the upper and foothold 80 that the opening region is on the first lateral side 18 of sole 12.

In the upper, the interior layer of fabric may be designed with a directional grain. Such a directional grain may make it easier to slide the foot in one direction than in the opposite direction. When assembling the footwear, the directional grain could be oriented to make donning easier than removal.

In accordance with the invention there may be provided a resilient foot holder located at least partially in a region of the upper and at least partially disconnected from the second side of the sole at the opening region to thereby permit lateral foot entry through the opening region, the foot holder for exerting a holding force on the foot to help prevent the foot from slipping out of the opening region during walking, and for deforming to permit the foot to slip out through the opening region in response to a lateral foot motion.

As disclosed in connection with one embodiment of the invention, and as illustrated in FIGS. 2A and 2B, resilient foot holder 30 extends over a region of the sole intermediate the toe region 14 and the heel region 16. An inside surface of foot holder 30 and a portion of the upper surface 26 of sole 12 define an envelope for a foot. Preferably, foot holder 30 is made of a resilient material such as semi-rigid plastic. The plastic may, for example, be polyethylene having a nominal thickness of 5 mm. The invention, in its broader sense, is not limited to any particular material for the foot holder. Any type of plastic, metal, composite, or other material having the requisite elastic properties may be used. As illustrated in FIG. 2A, foot holder 30 is connected to and extends from the sole at first side 18, and is disconnected from the sole at second side 20. Further details of the foot holder are illustrated in FIGS. 3A–3D.

Figure 3A:
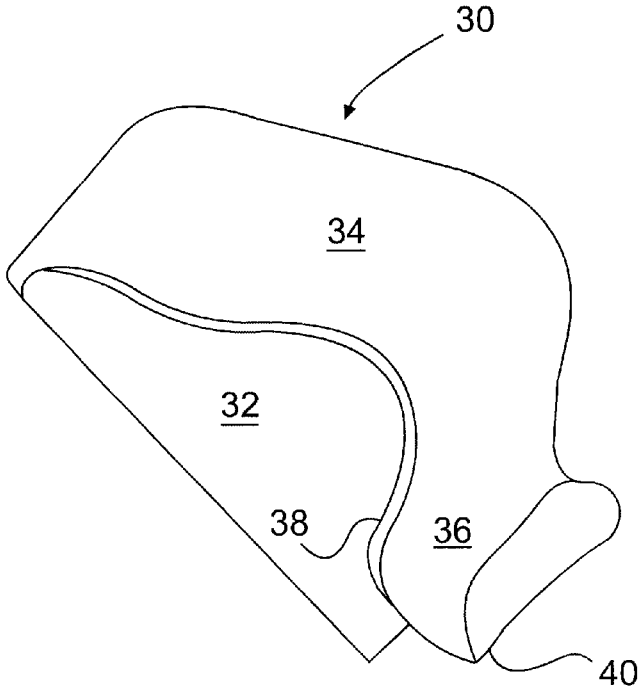
FIG. 3A is a perspective view of the foot holder illustrated in FIG. 2A.
Figure 3B:
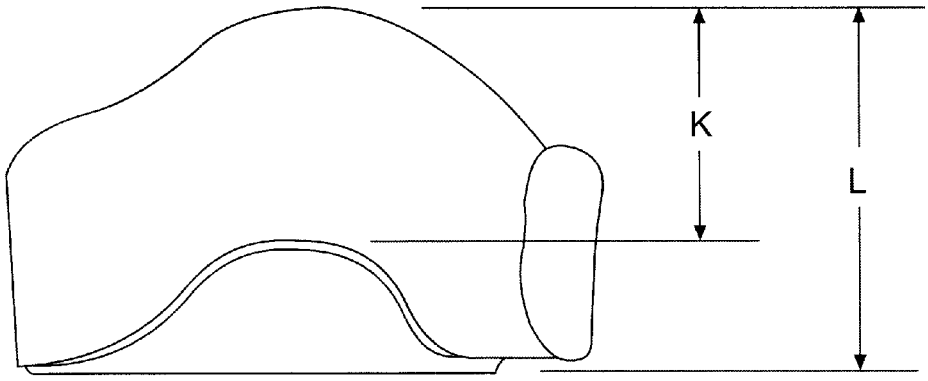
FIG. 3B is a dimensioned top view of the foot holder of FIG. 3A.

FIG. 3A illustrates, in perspective view, three general regions of the foot holder: sole connection region 32, metatarsal region 34, and flipped-back lip region 36. Sole connection region 32 is designed to provide a connection to sole 12. The connection may be formed by embedding sole connection region 32 within the sole. In a broader aspect of the invention, the foot holder may connect to the sole in differing ways or may not directly connect to the sole.

Figure 3C:
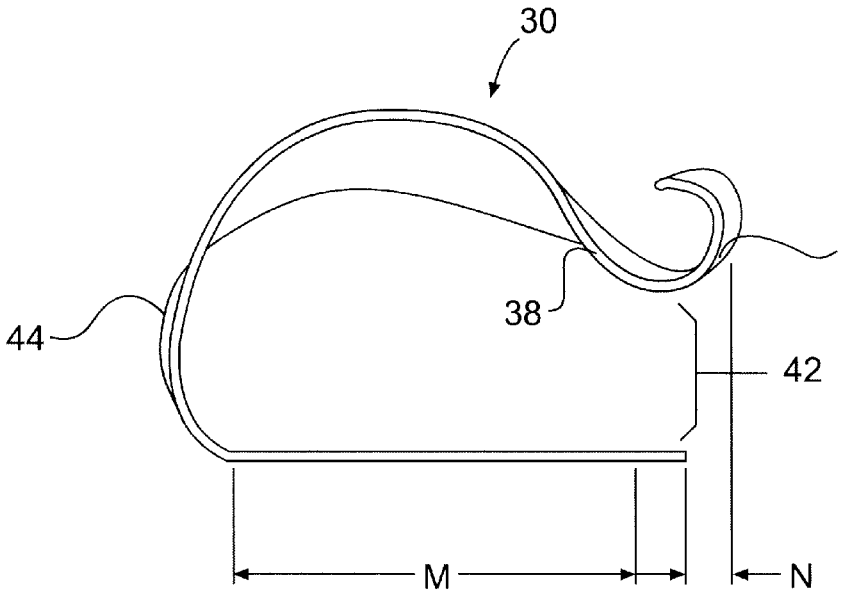
FIG. 3C is a dimensioned front view of the foot holder of FIG. 3A.
Figure 3D:
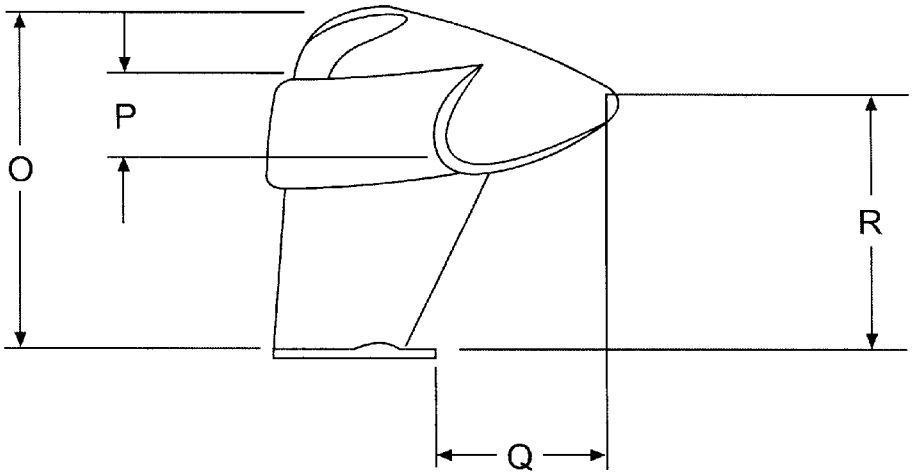
FIG. 3D is a dimensioned side view of the foot holder of FIG. 3A.
Figure 4A:
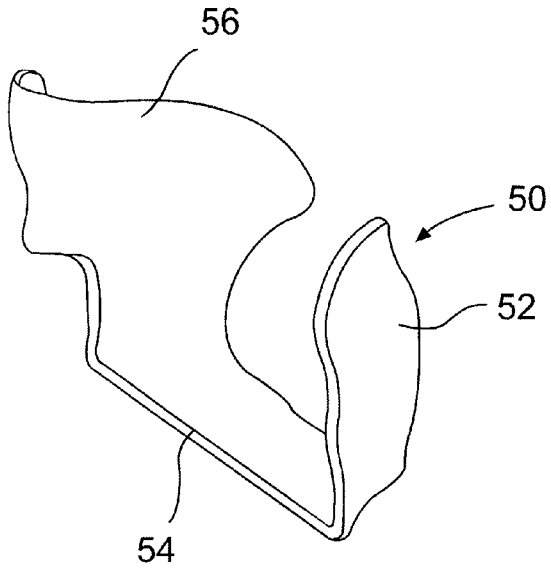
FIG. 4A is a perspective view of the heel holder illustrated in FIG. 2A.
Figure 4B:
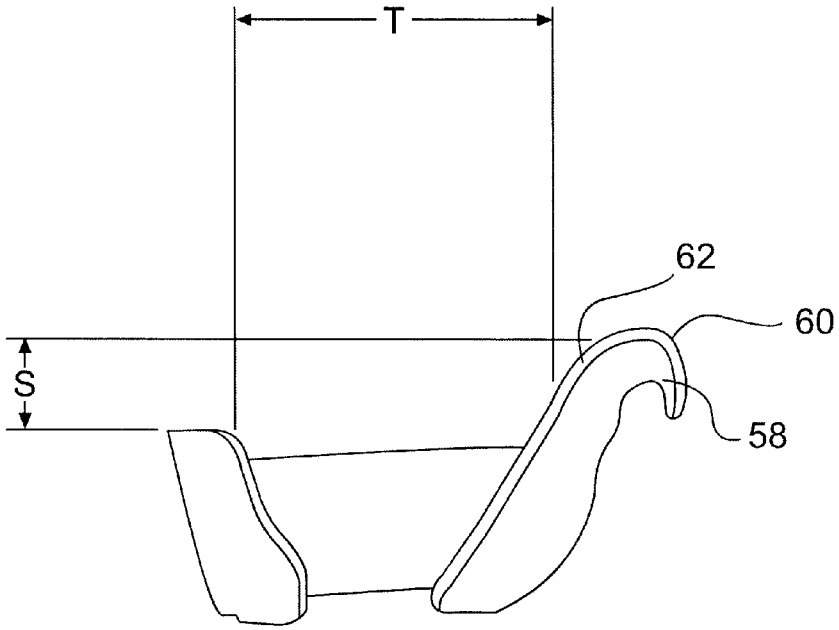
FIG. 4B is a dimensioned top view of the heel holder of FIG. 4A.
Figure 4C:
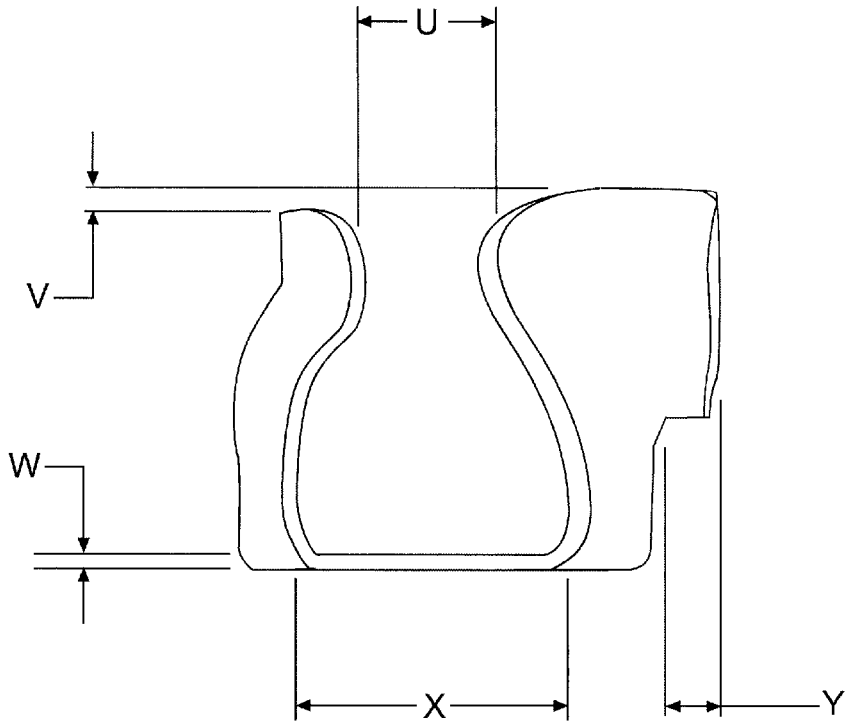
FIG. 4C is a dimensioned front view of the heel holder of FIG. 4A.
Figure 4D:
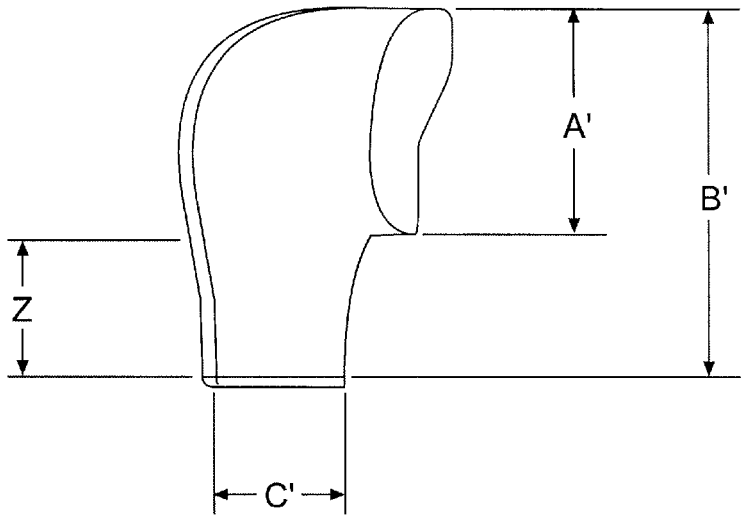
FIG. 4D is a dimensioned side view of the heel holder of FIG. 4A.

Metatarsal region 34 of the footholder 30 is curved to accommodate the upper curvature of the metatarsal bones in the foot. Flipped-back lip region 36 defines two radii 38 and 40. During donning of the footwear, radii 40 serves as a guide surface to direct the foot into the opening region 28. Once the foot has entered the footwear, radii 38 serves to resist the lateral movement of the foot to assist in preventing the foot from slipping out of opening region 28 during walking. FIG. 3C illustrates a front view of the foot holder. During entry of the foot into the footwear, the material of the foot holder 30 flexes, in part, at a connection region 44. This enables gap 42 to expand and accommodate the foot within the footwear. Once the footwear is donned, the gap 42 may diminish somewhat, at least with respect to a maximum aperture. Because the material of foot holder 30 is resilient, it will exert a holding force on the foot to prevent the foot from egress through gap 42. However, a lateral motion of the foot sufficient to overcome the holding force will permit egress of the foot. The size/existence of gap 42 may be a matter of design choice. For example, it may be that with the foot removed, the gap is non-existent.

As is evident from FIG. 2A, sole connection region 32 of foot holder 30 extends beneath the arch of the sole. The metatarsal region 34 curves forward in an area 44 in the center of the footwear. This forward curve 44 enables foot holder 30 to exert a holding force on the foot beyond the center line 48.

The exemplary footwear illustrated in FIG. 1 is constructed with a fabric upper designed in part for both warmth and aesthetics. However, the invention may be embodied within open footwear, such as a sandal. In such a case, the finished good may have an appearance quite similar to the illustrations of FIGS. 2A and 2B. In such an instance, the upper and the foot holder may be one in the same component. Similarly, in footwear that includes an upper, depending on the materials selected and/or the design, the upper itself may serve as a foot holder, eliminating the need for a separate foot holder structure. Thus, as used in the claims, the term "upper" may include a "foot holder," the term "foot holder" may include an upper, and the recitation of both does not necessarily require two separate structural elements.

In accordance with the invention, there may also be provided a heel holder located proximate the heel region, the heel holder for cooperating with the resilient foot holder to prevent the foot from slipping out of the opening during the walking. As illustrated in FIG. 2B, heel holder 50 is located near the heel region 16.

Detailed exemplary views of the heel holder 50 are illustrated in FIGS. 4A–4D. As can be seen in the perspective view of FIG. 4A, heel holder 50 may include a U-shaped structure for containing the heel of a wearer. A first leg 52 and a second leg 56 are joined by a linkage 54. As may be evident from FIG. 2A, linkage 54 is embedded within the sole 12 in the heel region 16, as is hidden from view in FIG. 2A. Like foot holder 30, heel holder 50 may have a curved surface such as flipped-back lip 58 defining radii 60 and 62. Radii 60 may be smaller than radii 62 for guiding a wearer's heel into the footwear. The greater diameter of radii 62 may assist in preventing the heel from slipping out through opening region 28 during walking.

Like foot holder 30, heel holder 50 is preferably made of a resilient material such as one of the same materials discussed above in connection with the foot holder 30. A series of perforations (not shown) may be made in the material of the heel holder 50. These perforations may reduce weight and they may facilitate ventilation. The invention may be constructed with or without perforations, and similar perforations may be provided in the foot holder 30.

While a preferred embodiment of the invention is illustrated as including a heel holder 50, the invention, in its broadest sense, does not necessarily require a resilient heel holder. It is possible that a non-resilient material might be used for the heel holder, the heel holder might be eliminated in its entirety, or some other mechanism may be used to reduce heel slippage.

As illustrated in FIG. 1, the curved radii 40 of the foot holder is embedded within fabric portion 40' and the curved radii 58 of heel holder 50 is embedded within fabric region 58'. Regions 40' and 58' may cooperate to funnel or guide a foot into the footwear.

Figure 5:
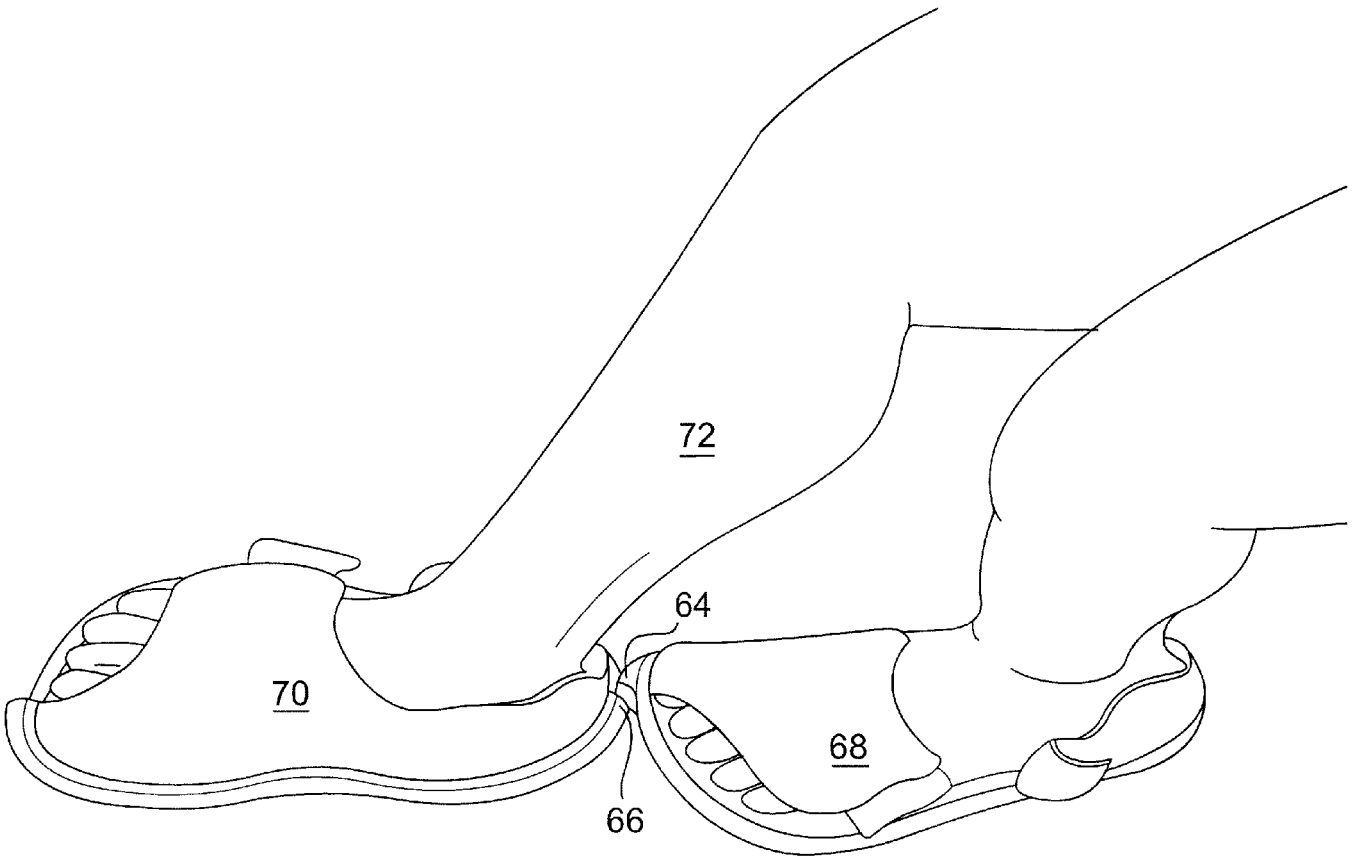
FIG. 5 is a top view of the orientation of a pair of footwear during the removal process in accordance with the invention.

In accordance with the invention, the sole may have at least one protrusion extending therefrom, the protrusion being configured to engage another protrusion on an opposite foot of a wearer, to thereby assist the wearer in removing the footwear. By way of example, and as illustrated in FIG. 2A, sole 12 includes outwardly facing tabs 64 and 66, respectively located at the toe region 14 and heel region 16 of the sole 12. Tabs 64 and 66 are designed to facilitate removal of the footwear without requiring tactile control and without requiring the wearer to bend at the waist. Although only a right shoe is illustrated in the figures, the left shoe may be a mirror image of the right. Thus, when a heel tab 66 of a right shoe passes in front of a toe tab 64 of a left shoe, the tabs will engage. This motion is illustrated in FIG. 5 where a wearer with a left shoe 68 firmly planted on the ground moves a right shoe 70 in front of the left so that heel tab 66 on shoe 70 engages toe tab 64 on shoe 68. As right leg 72 continues its lateral movement, shoe 70 is prevented from moving by the engagement of tabs 66 and 64. Thus, the right foot is ejected from shoe 70 when the lateral movement overcomes the holding forces exerted by shoe 70. To remove the left shoe, a wearer might thereafter step on removed shoe 70 to plant it firmly on the ground, and slide shoe 68 in front of shoe 70 to engage the tabs and affect shoe removal.

While an exemplary disclosed embodiment is directed to footwear that permits hands-free donning and removal, the invention in its broadest sense does not exclude the use of manual closures. Such manual closers may be appropriate for wearers who desire the ease of lateral foot entry in combination with the added security of a closure mechanism.

While tabs 64 and 66 are illustrated as outward facing, the invention, in its broadest sense is not so limited. The direction the tabs face might be reversed. In addition, any protrusion or other means of engaging the shoe of an opposite foot may be employed in connection with the invention. And in its broadest sense, the invention may not employ a mechanism for hands-free removal.

Listed below are a series of exemplary dimensions for the dimensional characters presented in the figures. The dimensions as well as the shapes illustrated are provided for purposes of disclosing the inventor's best mode of practicing the invention. However, the invention, in its broadest sense, is not limited to the particular shapes and dimensions disclosed. It is to be understood that various shapes and dimensions may be employed without departing from the scope and spirit of the invention.

| Figure | Dimensional Reference Character | Exemplary Dimension (mm) |
|---|---|---|
| 2A | A | 19.1 |
| 2A | B | 77 |
| 2A | C | 25.7 |
| 2A | D | 94.9 |
| 2A | E | 19.1 |
| 2A | F | 20.2 |
| 2A | G | 21.7 |
| 2A | H | 42.6 |
| 2B | I | 63 |
| 2B | J | 55.6 |
| 3B | K | 32.9 |
| 3B | L | 53.3 |
| 3C | M | 63.8 |
| 3C | N | 6.8 |
| 3D | O | 52.5 |
| 3D | P | 14 |
| 3D | Q | 27.7 |
| 3D | R | 39.5 |
| 4B | S | 13.5 |
| 4B | T | 49.5 |
| 4C | U | 22.3 |
| 4C | V | 3.7 |
| 4C | W | 1.8 |
| 4C | X | 44.2 |
| 4C | Y | 9.1 |
| 4D | Z | 22.7 |
| 4D | A' | 36.3 |
| 4D | B' | 60.8 |
| 4D | C' | 21.5 |

In the foregoing Description of Preferred Embodiments, various features of the invention are grouped together in a single embodiment for purposes of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Description of the Preferred Embodiments, with each claim standing on its own as a separate preferred embodiment of the invention.

What is claimed is:

1. Footwear, comprising:

a sole having a toe region, a heel region, and first and second opposing lateral sides;

an upper connected to the sole along at least a portion of the first lateral side, and being disconnected from the sole in an opening region along at least a portion of the second lateral side, the opening region being elongated and extending along a lateral side of the footwear adjacent the sole; and a resilient foot holder located at least partially in a region of the upper and at least partially disconnected from the second side of the sole at the opening region to thereby permit lateral foot entry through the opening region, the foot holder for exerting a holding force on a foot to help prevent the foot from slipping out of the opening region during walking, and for deforming to permit the foot to slip out through the opening region in response to a lateral foot motion.

2. Footwear according to claim 1, wherein the sole has at least one protrusion extending therefrom, the protrusion being configured to engage another protrusion on an opposite foot of a wearer, to thereby assist the wearer in removing the footwear.

3. Footwear according to claim 1, further comprising a heel holder located proximate the heel region, the heel holder for cooperating with the resilient foot holder to prevent a foot from slipping out of the opening region during walking.

4. Footwear according to claim 3, wherein the foot holder and the heel holder each include a flipped-back lip for guiding a foot into the opening region.

5. Footwear according to claim 1, wherein the foot holder is curved to generally conform to a metatarsal portion of the foot.

6. Footwear according to claim 3, wherein the heel holder is made of a resilient material capable of deformation during entry and egress of a foot.

7. Footwear according to claim 3, wherein at least one of the foot holder and heel holder include a curved guide surface for directing the foot into the opening region.

8. Footwear according to claim 7, wherein the at least one guide surface is a portion of a flipped-back lip.

9. Footwear according to claim 8, wherein an outer radius of the lip is greater than an inner radius of the lip.

10. Footwear according to claim 1, wherein the sole includes a ridge for at least partially surrounding the foot to thereby assist in preventing the foot from slipping out of the opening region during walking.

11. Footwear according to claim 1, wherein the sole further includes a first sole protrusion in the toe region and second sole protrusion in the heel region, the protrusions being configured to assist a wearer with footwear removal.

12. Footwear according to claim 1, further comprising a texture on a foot contacting portion of the sole, the texture being oriented to make it easier for the foot to slip into the opening region than for the foot to exit the opening region.

13. Footwear, comprising:

a sole having opposing lateral sides;

an upper including a resilient foot holder at least partially connected to the sole along a first lateral side thereof, and at least partially disconnected from the sole in an opening region on an opposite second lateral side thereof, the opening region being elongated and extending along a lateral side of the footwear adjacent the sole, the resilient foot holder for exerting a holding force on a foot of a wearer to help prevent the foot from slipping out of the opening region during walking, and for deforming, in response to lateral foot movement, to thereby permit the foot to be removed through the opening region.

14. Footwear according to claim 13, wherein the foot holder includes a portion connected to the first side to the sole.

15. Footwear comprising:

a sole having a toe region, a heel region, and first and second opposing lateral sides;

an upper extending over at least a portion of the sole, the upper being disconnected from the sole in at least a lateral opening region located along a lateral edge of the sole, the opening region being elongated and extending along a lateral side of the footwear adjacent the sole; and a resilient foot holder located at least in part in a portion of the upper and being disconnected from the sole at least at the lateral opening region, the resilient foot holder for exerting a holding force on the foot to help prevent the foot from slipping out of the lateral opening region during walking, and for permitting the foot to slip out through the lateral opening region in response to a lateral foot motion.

16. The footwear of claim 15, wherein the upper and the resilient foot holder are integrally formed.

17. The footwear of claim 16, wherein the upper is made, at least in part, of a fabric material and the foot holder is made of a semi-rigid material, and wherein the fabric at least partially surrounds the semi-rigid material.

18. Footwear, comprising:

a sole having a toe region, a heel region, and first and second opposing lateral sides;

an upper connected to the sole along at least a portion of the first lateral side, and being disconnected from the sole in an opening region along at least a portion of the second lateral side the opening region being elongated and extending along a lateral side of the footwear adjacent the sole; and a first protrusion extending from the toe region; and a second protrusion extending from the heel region, wherein the first and second protrusions are configured to engage first and second protrusions on an opposite sole to assist a wearer in hands-free removal the footwear.

19. Footwear, comprising:

a sole having first and second lateral sides; and a foot holder connected to the sole and configured to exert a holding force on a metatarsal region of a foot, wherein a surface of the foot holder and the sole define a gap configured to enable a foot to enter and exit through the gap in response to a generally lateral motion of the foot, wherein the gap is elongated and extends along a lateral side of the footwear adjacent the sole.

20. Footwear, comprising:

a sole having a toe region, a heel region, and first and second opposing lateral sides;

an upper connected to the sole along at least a portion of the first lateral side, and being disconnected from the sole in an opening region along at least a portion of the second lateral side, the opening region being elongated and extending along a lateral side of the footwear adjacent the sole; and a resilient foot holder located at least partially in a region of the upper and at least partially disconnected from the second side of the sole at the opening region to thereby permit lateral foot entry through the opening region.

21. Footwear, comprising:

a sole having a toe region, a heel region, and first and second opposing lateral sides;

an upper connected to the sole along at least a portion of the first lateral side;

a lateral opening region in the second lateral side of the upper, the opening region being elongated and extending along a lateral side of the footwear adjacent the sole; and a resilient foot holder located at least partially in a portion of the upper and having a foot holder opening corresponding to the lateral opening region, the foot holder being configured for permitting lateral foot entry through the lateral opening region, for exerting a holding force on a foot to help prevent the foot from slipping out of the lateral opening region during walking, and for deforming to permit the foot to slip out through the lateral opening region in response to a lateral foot motion.

* * * * *

UNITED STATES PATENT AND TRADEMARK OFFICE

CERTIFICATE OF CORRECTION

PATENT NO. : 6,578,288 B2
DATED : June 17, 2003
INVENTOR(S) : Noam Bernstein

It is certified that error appears in the above-identified patent and that said Letters Patent is hereby corrected as shown below:

Column 8,
Line 26, "side the" should read -- side, the --.
Line 33, "removal the" should read -- removal of the --.

Signed and Sealed this

Nineteenth Day of August, 2003

JAMES E. ROGAN
*Director of the United States Patent and Trademark Office*